US010250005B2

(12) United States Patent
Montminy

(10) Patent No.: US 10,250,005 B2
(45) Date of Patent: Apr. 2, 2019

(54) CABLE INSTALLATION AID FOR MULTI-STRAND ELECTRICAL CONDUCTORS

(71) Applicant: Hubbell Incorporated, Shelton, CT (US)

(72) Inventor: Armand Thomas Montminy, Hooksett, NH (US)

(73) Assignee: Hubbell Incorporated, Shelton, CT (US)

( * ) Notice: Subject to any disclaimer, the term of this patent is extended or adjusted under 35 U.S.C. 154(b) by 1150 days.

(21) Appl. No.: 14/188,038

(22) Filed: Feb. 24, 2014

(65) Prior Publication Data

US 2015/0244131 A1 Aug. 27, 2015

(51) Int. Cl.
*H01R 43/28* (2006.01)
*H01R 43/05* (2006.01)

(52) U.S. Cl.
CPC ..... *H01R 43/28* (2013.01); *H01R 43/05* (2013.01); *Y10T 29/49117* (2015.01); *Y10T 29/49174* (2015.01)

(58) Field of Classification Search
CPC ... H01R 43/28; H01R 43/05; Y10T 29/49174; Y10T 29/49117; Y10T 29/49002
USPC ..... 29/857, 825, 592.1
See application file for complete search history.

(56) References Cited

U.S. PATENT DOCUMENTS

| | | | | |
|---|---|---|---|---|
| 2,591,550 | A * | 4/1952 | Kane | H05K 13/0007 254/134.3 R |
| 3,844,923 | A * | 10/1974 | Sandrock | C25D 17/18 204/213 |
| 5,402,693 | A * | 4/1995 | Hoffa | H02G 1/1256 81/9.51 |
| 5,567,187 | A | 10/1996 | Bellinger | |
| 5,678,302 | A * | 10/1997 | Miyadai | B29C 65/342 140/92.2 |
| 7,074,077 | B2 * | 7/2006 | Sakaguchi | H01R 4/70 174/76 |
| 7,237,336 | B2 | 7/2007 | Campbell | |
| 8,357,007 | B2 | 1/2013 | Ihde et al. | |
| 2006/0160369 | A1 * | 7/2006 | Lin | C23C 18/08 438/758 |
| 2010/0096158 | A1 | 4/2010 | Wheatley | |

FOREIGN PATENT DOCUMENTS

| | | | |
|---|---|---|---|
| DE | 3410907 | A1 | 10/1985 |
| JP | H 11135162 | A | 5/1999 |
| JP | 2004273333 | A | 9/2004 |
| JP | 2014029792 | A * | 2/2014 |

* cited by examiner

*Primary Examiner* — Peter DungBa Vo
*Assistant Examiner* — Azm Parvez
(74) *Attorney, Agent, or Firm* — Michael Best & Friedrich, LLP

(57) ABSTRACT

Provided is a method of preparing a connection for an electrical conductor. The insulation layer of an electrical conductor is cut and the insulation is separated into a first portion and a second portion. The second portion is moved away from the first portion to at least partially expose conductor strands of the electrical conductor. A strand retainer is placed around the exposed conductor strands. The insulation second portion is removed from the electrical conductor. The exposed conductor strands are inserted into an electrical connector.

15 Claims, 5 Drawing Sheets

CABLE INSTALLATION AID FOR MULTI-STRAND ELECTRICAL CONDUCTORS

FIELD OF THE INVENTION

The present invention relates to installation aids for multi-strand electrical conductors, especially those with a removable outer insulation layer.

BACKGROUND OF THE INVENTION

Electrical connectors are typically used to mechanically and electrically connect an electrical conductor with another device, such as an outlet or a terminal block. Different types of connectors, such as blade, ring, fork, or lug connectors may be used depending on the application. Typically the connector has an end for receiving an electrical conductor and a blade or pad that mechanically and electrically connects with an appropriate receptacle on a device.

Electrical conductors come in various sizes and typically include one or more conductor strands surrounded by an outer layer of insulation. To attach a connector to then conductor, one or more conductor wires are initially striped of insulation at an end to expose the conductor strands. The exposed conductor strands are then placed in contact with a conductor-receiving portion of the connector. The connector and conductor(s) are assembled and are then secured to one another, for example through a crimping operation.

One type of electrical conductor typically used with a connector is a multi-strand conductor. Multi-strand conductors are composed of a group of small conductor strands that are wrapped in a particular manner inside insulation to make a larger conductor, as opposed to a single solid strand conductor. Multi-strand conductors are more flexible and resistant to kinks compared to solid strand conductors of the same size of conductor.

The smaller the strands in a multi-strand conecutor, the greater the flexibility of the conductor. Smaller strands also require a greater number of strands for a given size. Accordingly, applications requiring high flexibility utilize conductors having a large number of strands of a minimal size.

SUMMARY OF THE INVENTION

A method of preparing a connection for an electrical conductor includes placing a strand retainer around exposed conductor strands on an electrical conductor. The electrical conductor has a plurality of conductor strands and an insulation layer surrounding at least a portion of the conductor strands, wherein at least a portion of the conductor strands are exposed. The exposed conductor strand is inserted into an electrical connector.

A method of preparing a connection for an electrical conductor includes cutting the insulation layer of an electrical conductor. The insulation is separated into a first portion and a second portion. The second portion is moved away from the first portion to at least partially expose conductor strands of the electrical conductor. A strand retainer is placed around the exposed conductor strands. The insulation second portion is removed from the electrical conductor. The exposed conductor strands are inserted into an electrical connector.

A method of preparing a connection for an electrical conductor includes placing a strand retainer around an electrical conductor having an insulation layer and a plurality of conductor strands. The insulation layer is cut to separate the insulation layer into a first portion and a second portion. The insulation second portion is removed to at least partially expose the conductor strands. The strand retainer is moved from the insulation first portion to the exposed conductor strands.

A method of preparing a connection for an electrical conductor includes providing an electrical connector having a conductor attachment end and a contact end and providing an electrical conductor having a first end, a second end, and an insulation layer surrounding a plurality of conductor strands. A resilient strand retainer is provided having an inner diameter and an outer diameter. The strand retainer is placed over the electrical conductor. At least a portion of the insulation is cut proximate the second end and a portion of the conductor strands are exposed proximate the second end. The strand retainer is moved onto the exposed portion of the conductor strands. The cut portion of the insulation is removed from the conductor strands and the exposed conductor strands are inserted into the conductor attachment end of the electrical connector.

Other embodiments, including apparatus, systems, methods, and the like which constitute part of the invention, will become more apparent upon reading the following detailed description of the exemplary embodiments and viewing the drawings. It is to be understood that both the foregoing general description and the following detailed description are exemplary and explanatory only and therefore not restrictive.

BRIEF DESCRIPTION OF THE DRAWINGS

The accompanying drawings are incorporated in and constitute a part of the specification. In such drawings.

Figure 1:
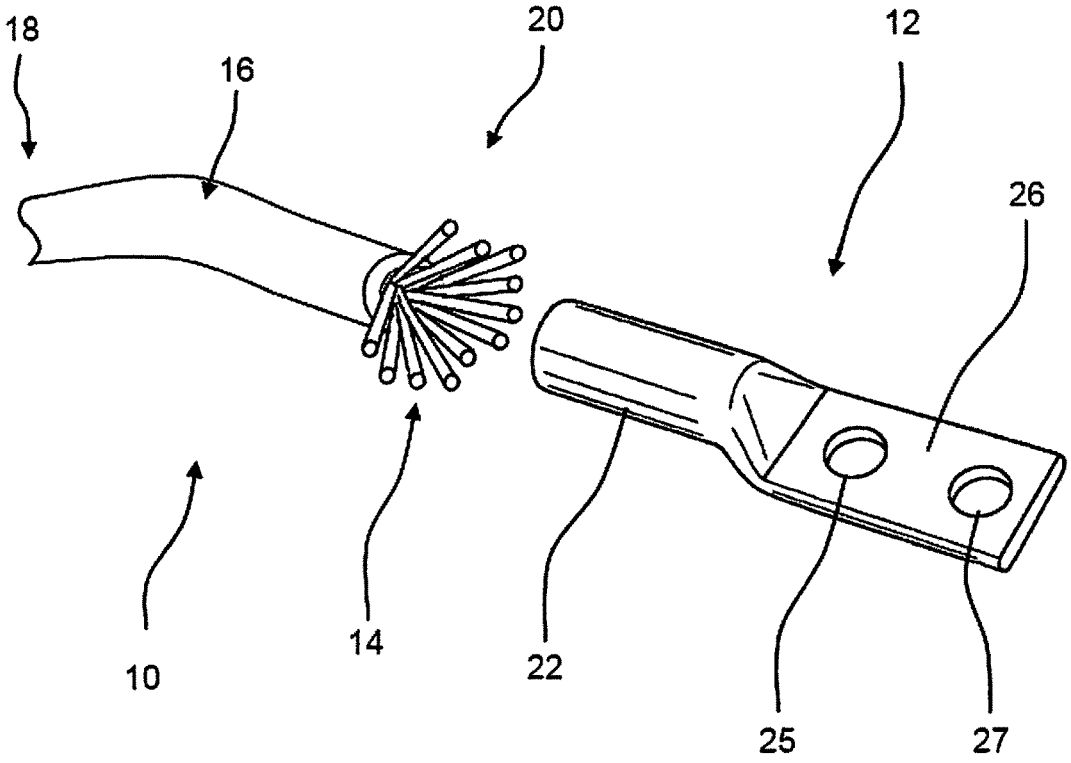
FIG. 1 is perspective view of a partially stripped multi-strand conductor and a connector.

DETAILED DESCRIPTION OF THE EXEMPLARY EMBODIMENT AND EXEMPLARY METHOD OF THE INVENTION

Reference will now be made in detail to exemplary embodiments and methods of the invention as illustrated in the accompanying drawings, in which like reference characters designate like or corresponding parts throughout the drawings.

FIG. 1 shows a conductor 10 and a connector 12 for receiving the conductor 10. The conductor 10 has a plurality of strands 14, advantageously formed of conductive material such as metal, surrounded by a layer of insulation 16, advantageously formed of isolative material such as rubber or plastic. The conductor 10 has a first end 18 and a second end 20 with the second end 20 stripped of the insulation layer 16 to expose the strands 14. The connector 12 is depicted as a lug connector having a barrel 22 with a central cavity 24 for receiving the conductor 10 and a terminal pad 26. The inner diameter of the barrel 22 can be substantially equal to, slightly greater than, or slightly smaller than the outer diameter of the strands 14. The terminal pad 26 includes a first hole 25 and a second hole 27 for receiving a mechanical fastener (not shown) to attach the connector 12 to a device. After the conductor 10 is inserted into the barrel 22, a crimping operation may be performed to deform the barrel 22 and secure the connector 12 to the conductor 10. In various alternative embodiments, any size, shape, and type of conductor 10 as well as any size, shape, and type of connector 12 may be utilized as would be understood by one of ordinary skill in the art.

The insulation layer 16 includes an outer surface 28 defining an outer diameter and an inner surface 30 approximately defining a core diameter. The strands 14 are formed into a substantially cylindrical group having an outer surface 32 that also approximately defines the core diameter. As such, the core diameter is representative of both the inner surface 30 of the insulation 16 and the outer surface 32 of the group of strands 14 when contained by the insulation 16, although various levels of tolerance may apply. As discussed above, different sizes, shapes, and types of conductors 10 may be utilized, and the insulation 16 outer diameter and core diameter need not be associated with a circular cross section and may relate to the length of any line extending from a central area of the conductor to an outer surface.

As best shown in FIG. 1, when the insulation 16 is removed from the conductor 10, the exposed strands 14 have a tendency to splay in different directions, breaking the core diameter and fanning radially out from the central axis of the conductor 10. Certain applications require conductors 10 to have a large amount of flexibility, resulting in an increase of conductor strands 14 at a reduced size. The greater the number of strands 14 and the smaller their size, the greater the tendency for the strands 14 to splay, making it more difficult to insert the exposed strands 14 into a connector 12. Stray strands 14 not secured inside the connector 12 may cause the conductor 10 to short or may pose a shock hazard to a user. If a connector 12 is found to have stray strands 14, it may need to be recrimped, wasting time and material.

A strand retainer 34 prevents the strands 14 from splaying prior to insertion as best shown in FIGS. 2-8. The strand retainer 34 has an inner surface 36 bounding a retainer inner diameter and an outer surface 38 bounding a retainer outer diameter. The strand retainer 34 is a resilient or elastic member that is capable of having an unstretched inner diameter smaller than the core diameter. In various alternative embodiments, the unstretched inner diameter may be approximately equal to or slightly greater than the core diameter or the size of the intended connector. While a toroid strand retainer 34 is shown, the shape and cross-section of the strand retainer 34 may vary to include other arcuate and polygonal shapes. The strand retainer 34 may be made from any suitable resilient material, such as an elastomeric material, although polymers, metals, and composite materials may also be used. In various exemplary embodiments, the strand retainer 34 may be similar to an o-ring.

Figure 2:
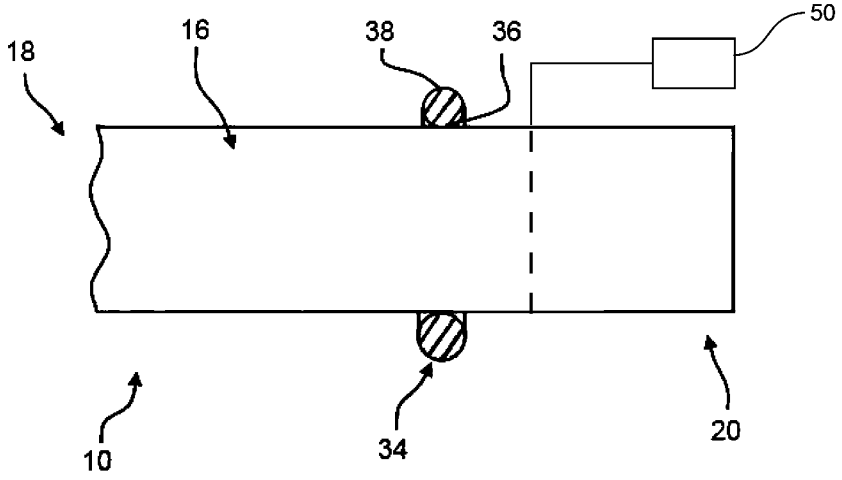
FIG. 2 is a side view of a conductor and a strand retainer according to an exemplary embodiment.
Figure 3:
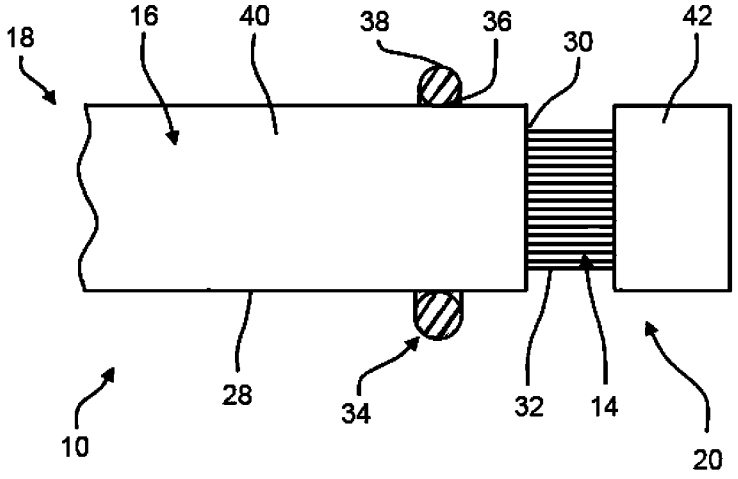
FIG. 3 is a side view of the conductor and strand retainer of FIG. 2 with the insulation cut and partially removed to expose the conductor strands.
Figure 4:
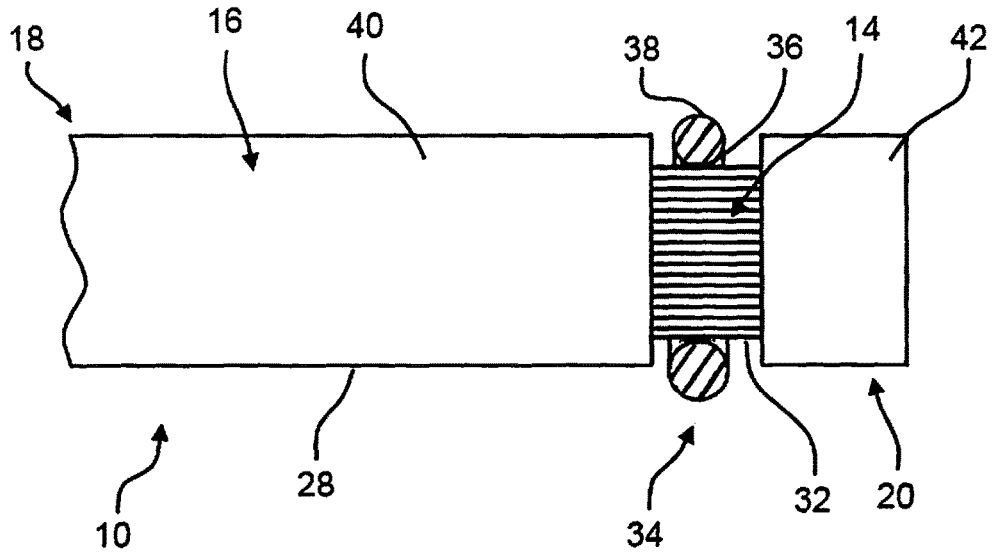
FIG. 4 is a side view of the conductor and strand retainer of FIG. 3 with the strand retainer placed over the exposed strands.

FIGS. 2-8 depict an exemplary method of utilizing the strand retainer 34. As shown in FIG. 2, the strand retainer 34 is placed over the insulation 16 of the conductor 10. The insulation 16 may then be cut 50 to approximately the core diameter separating the insulation 16 into a first portion 40 and a second portion 42 as shown in FIG. 3. The second portion 42 of the insulation 16 may be moved to partially expose the strands 14. After the strands 14 are exposed, the strand retainer 34 may be moved over the strands 14. The strand retainer 34 may simply fit over the strands 14 at approximately the core diameter or it may provide compression to the strands 14. The strand retainer 34 may also be sized with relation to the central cavity 24 of the connector barrel 22.

In an alternative embodiment, the electrical conductor 10 may be cut 50 to approximately the core diameter separating the insulation 16 into a first portion 4o and a second portion 42. The second portion 42 of the insulation 16 may be moved to partially expose the strands 14. After the strands 14 are exposed, the strand retainer 34 may be placed around the electrical conductor 10 and brought into contact with the exposed strands 14. The strand retainer 34 may also be placed along the cut line prior to movement of the second portion 42 so that the strand retainer 34 moves onto the exposed strands 14 as the insulation second portion 42 is removed.

Figure 5:
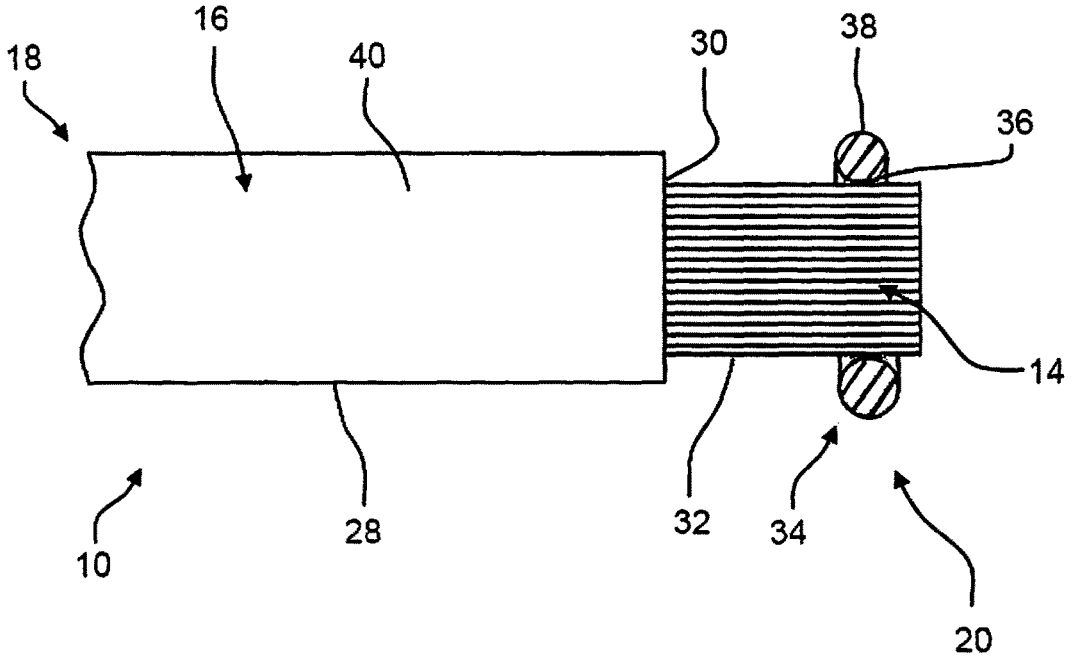
FIG. 5 is a side view of the conductor and strand retainer of FIG. 4 with the cut portion of the insulation removed and the strand retainer moved proximate the end of the conductor.

With the strand retainer 34 placed over the strands 14, the second portion 42 of the insulation 16 may be further removed from the strands 14. As best shown in FIG. 5, the strand retainer 34 is moved to the second end 20 of the conductor to prevent or minimize splaying of the strands 14. The strand retainer 34 may be moved proximate the second end 20 of the conductor 10 as the second portion 42 of the insulation 16 is removed or after the second portion 42 of the insulation 16 has been fully removed. The strand retainer 34 may be positioned slightly away from the second end 20, leaving a portion of the strand ends exposed to be placed into the connector 12. Depending on the amount of insulation 16 removed, the strand retainer 34 may not need to be moved from its initial placement over the strands 14.

Figure 6:
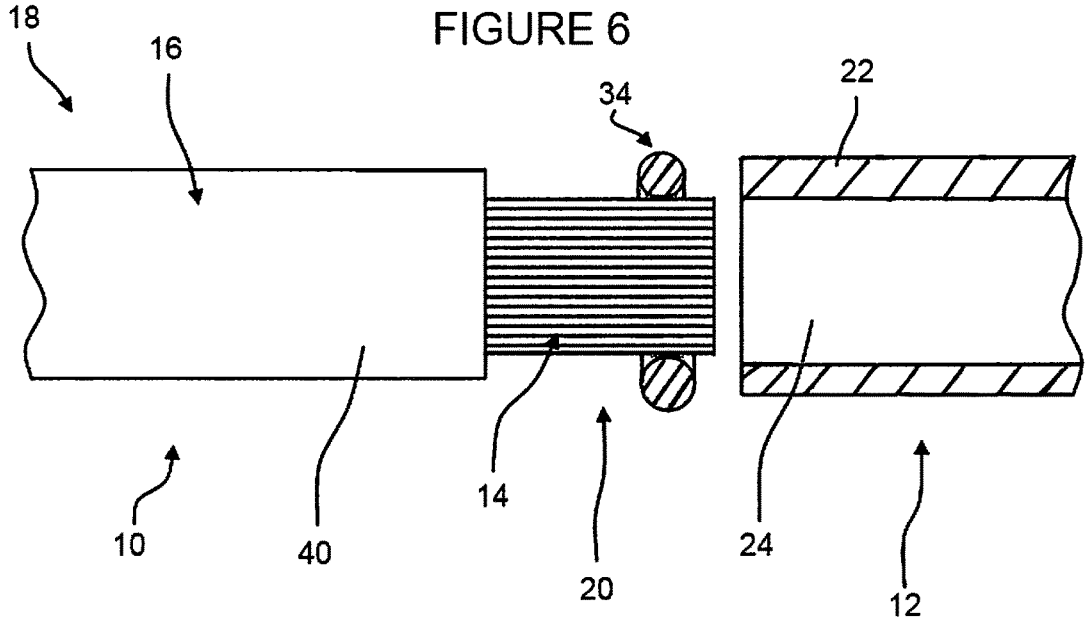
FIG. 6 is a side view of the conductor and strand retainer of FIG. 5 and a connector.
Figure 7:
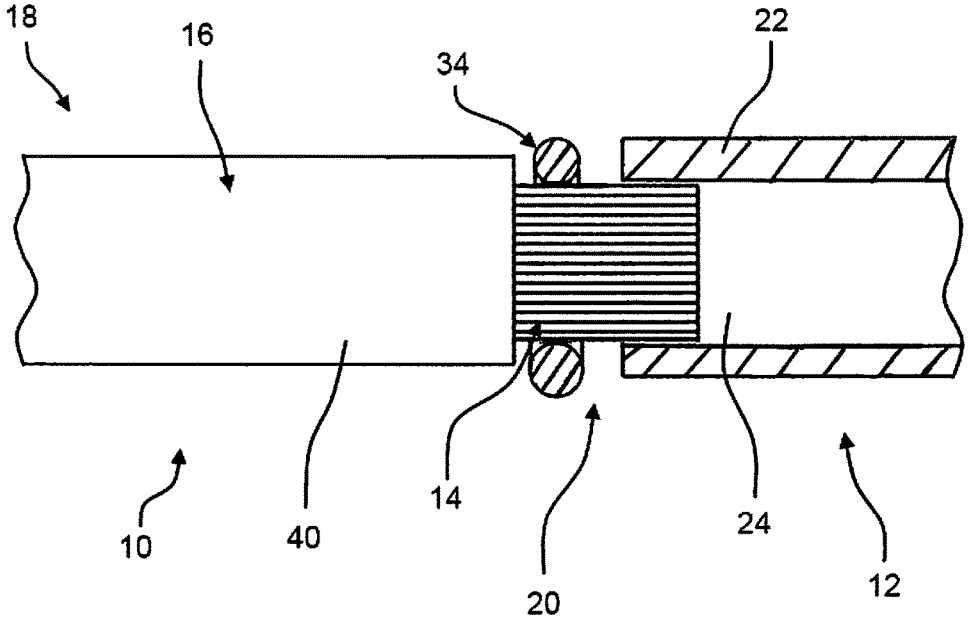
FIG. 7 is a side view of the conductor and strand retainer of FIG. 6 with the exposed strands introduced into the connector and the strand retainer moved away from the second end of the conductor.
Figure 8:
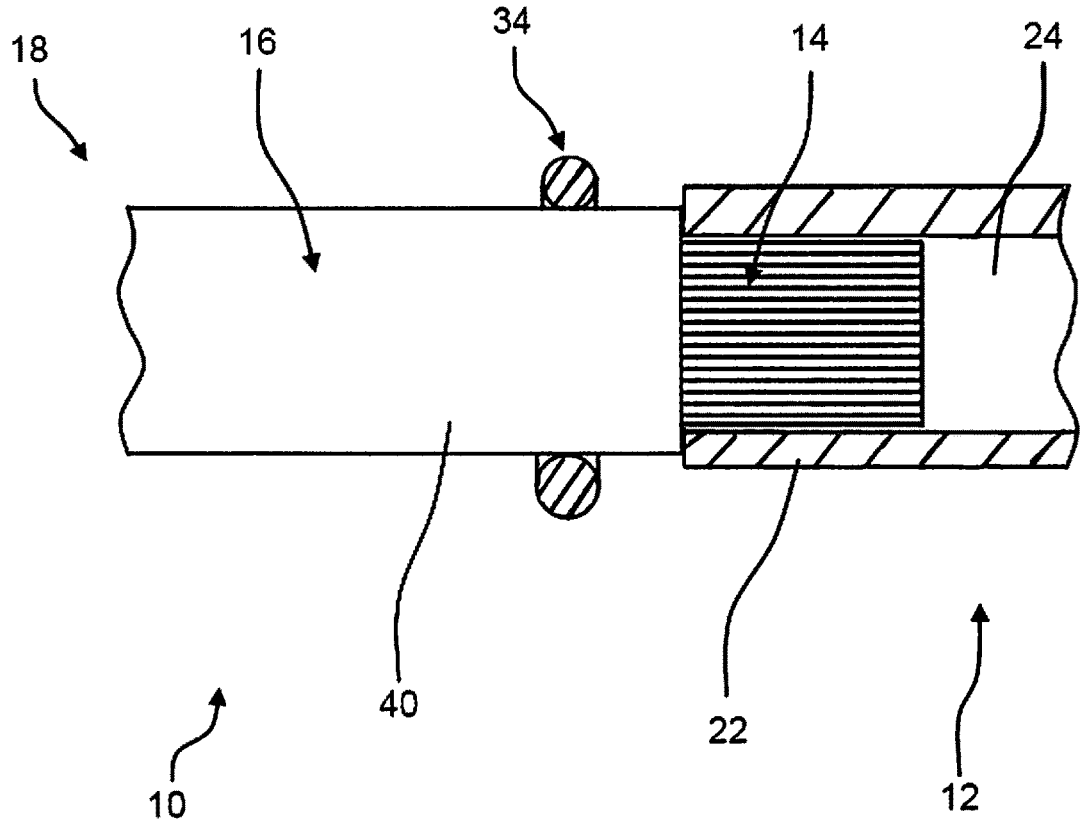
FIG. 8 is a side view of the conductor and strand retainer of FIG. 7 with the exposed strands fully inserted into the connector.

After the second portion 42 of the insulation 16 has been removed, the conductor 10 is aligned with the connector barrel 22 as shown in FIG. 6. The strands 14 are then inserted into the central cavity 24 of the barrel 22. As the conductor 10 is inserted into the connector 12, the strand retainer 34 may be moved away from the second end 20 of the conductor 10. The strand retainer 34 may ultimately be moved back onto the first portion 18 of the insulation 16 as best shown in FIGS. 7 and 8 or it may remain at least partially on the strands 14. The strand retainer 34 may be moved as the connector 12 is moved, or the strand retainer 34 may be moved as soon as the exposed strands 14 are inserted into the central cavity 24 of the barrel 22. In various exemplary embodiments, the connector 12 may be used to displace the strand retainer 34.

After the conductor 10 is inserted into the connector 12 a desired distance, the connector 12 and conductor 10 may be secured together, for example by a crimping operation. The strand retainer 34 may be left on the conductor 10 or it may be removed from the conductor 10, for example by sliding the strand retainer 34 over the connector 12 or by cutting or breaking the strand retainer 34. In various alternative embodiments, the strand retainer 34 may be removed prior to complete insertion of the conductor 10 into the connector 12.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

What is claimed:

1. A method of preparing a connection for an electrical conductor comprising the steps of:

cutting an insulation layer of an electrical conductor to separate the insulation layer into a first portion and a second portion, the electrical conductor including an outer diameter and a core diameter;

moving the second portion away from the first portion, thereby exposing a segment of conductor strands of the electrical conductor;

placing a strand retainer around the electrical conductor;

placing the strand retainer onto the exposed segment of conductor strands, the strand retainer has an unstressed inner diameter that is less than the electrical conductor outer diameter;

removing the insulation second portion from the electrical conductor; and inserting the exposed conductor strands into an electrical connector.

2. The method of claim 1, wherein the strand retainer is placed onto the electrical conductor prior to the cutting step.

3. The method of claim 1, wherein the strand retainer is placed onto the electrical conductor subsequent to the cutting step and prior to the moving step.

4. The method of claim 1, wherein the strand retainer is placed onto the exposed segment of conductor strands subsequent to the moving step.

5. The method of claim 1, further comprising moving the strand retainer from the exposed segment of conductor strands to the insulation first portion as the exposed segment of conductor strands are inserted into the electrical connector.

6. The method of claim 1, further comprising removing the strand retainer from the electrical conductor subsequent to the inserting step.

7. The method of claim 1, wherein the strand retainer unstressed inner diameter is less than the electrical conductor core diameter.

8. The method of claim 1, wherein the strand retainer comprises an elastomeric material.

9. A method of preparing a connection for an electrical conductor comprising the steps of:

placing a strand retainer around an electrical conductor having an insulation layer and a plurality of conductor strands;

cutting the insulation layer to separate the insulation layer into a first portion and a second portion;

moving the insulation second portion to expose a segment of the conductor strands;

moving the strand retainer from the insulation first portion onto and around the exposed segment of conductor strands;

removing the insulation second portion from the electrical conductor;

inserting the exposed conductors strands into an electrical connector; and removing the strand retainer from the electrical conductor after inserting the exposed segment of conductor strands in the electrical connector.

10. The method of claim 9, further comprising moving the strand retainer from the exposed segment of conductor strands to the insulation first portion as the exposed segment of conductor strands are inserted into the electrical connector.

11. The method of claim 9, wherein the strand retainer comprises an elastomeric material.

12. The method of claim 9, wherein the strand retainer comprises an o-ring.

13. A method of preparing a connection for an electrical conductor comprising the steps of:

providing an electrical connector having a conductor attachment end and a contact end;

providing an electrical conductor having a first end, a second end, a plurality of conductor strands, and an insulation layer surrounding the plurality of conductor strands;

providing a resilient strand retainer having an inner diameter and an outer diameter;

placing the strand retainer over the electrical conductor;

cutting at least a portion of the insulation proximate the second end;

exposing a portion of the conductor strands proximate the second end;

moving the strand retainer onto the exposed portion of the conductor strands;

removing the cut portion of the insulation from the conductor strands;

inserting the exposed conductor strands into the conductor attachment end of the electrical connector; and removing the strand retainer from the electrical conductor after inserting the exposed conductor strands in the electrical connector.

14. The method of claim 13, further comprising moving the strand retainer from the exposed conductor strands to the remaining insulated portion as the exposed conductor strands are inserted into the electrical connector.

15. The method of claim 13, wherein the strand retainer comprises an elastomeric material.

* * * * *